US005596869A

United States Patent [19]

Messerer

[11] Patent Number: 5,596,869

[45] Date of Patent: Jan. 28, 1997

[54] CHAIN NECKLACES

[76] Inventor: Beat Messerer, Munsterhoff 14, 8001 Zurich, Switzerland

[21] Appl. No.: 323,486

[22] Filed: Oct. 14, 1994

[30] Foreign Application Priority Data

Oct. 15, 1993 [CH] Switzerland ..... 3117/93

[51] Int. Cl.[6] ..... F16G 15/00

[52] U.S. Cl. ..... 59/82; 59/84

[58] Field of Search ..... 59/78, 80, 82, 59/84, 85

[56] References Cited

U.S. PATENT DOCUMENTS

| | | | |
|---|---|---|---|
| 245,594 | 8/1881 | Whitney | 59/82 |
| 645,202 | 3/1900 | Carter | 59/78 |
| 4,123,900 | 11/1978 | Sadowski | 59/85 |
| 4,654,936 | 4/1987 | Courtney | 59/85 |

FOREIGN PATENT DOCUMENTS

| | | | |
|---|---|---|---|
| 741032 | 2/1933 | France | 59/85 |
| 137818 | of 0000 | Germany | 59/80 |
| 634635 | 8/1936 | Germany | 59/80 |

*Primary Examiner*—David Jones
*Attorney, Agent, or Firm*—Hawes, Fischer & Dickinson

[57] ABSTRACT

Disclosed is a chain formed from a series of at least two successive links that are joined end-to-end one to another. One of the two links has a gripping element for holding the other link at a particular position relative to the first link so that the chain can be lengthened or shortened without adding or removing a link or links.

8 Claims, 4 Drawing Sheets

CHAIN NECKLACES

P FIELD OF THE INVENTION

The invention submitted concerns chains, in particular necklaces which are in part made up of closed links.

BACKGROUND ART

The lengthening or shortening of chains has presented a problem which has been unsatisfactorily solved to date. As a rule this problem has been accomplished by adding or removing links which requires that one of the links has to be opened and the availability of a mechanism by which to open and close the links.

SUMMARY OF THE INVENTION

Particularly with necklaces, as with decorative chains, these solutions are neither desirable nor recommended. Especially with very precious jewelry, the use of open or reclosable links can have unfortunate consequences as the individual links can be mislaid or even lost. In spite of this, the desire can still exist to adjust the length of a necklace depending on the clothes worn and different applications.

It is therefore the object of the invention that a chain and, in particular, a necklace is made up of so-called closed links, where the chain can be lengthened or shortened without adding or removing links.

It is proposed that chains comprising, at least in part, two successive links are joined to where one of the two links has a gripping element for holding the successive links relative to one another so that the chain can be either lengthened or shortened without adding or removing a link or links.

The chain described herein can be made from any material such as plastic or metal, or it can be worn as a necklace, in particular jewelry made from a precious metal, e.g. gold. According to a preferred embodiment, an opening or passage is established at one link so that the following link can be moved therethrough. However, the passage is sized to hinder or block the movement of the following link in the opposite direction therethrough.

The proposed solutions pursuant to the invention are not limited to chains, in particular jewelry, but may be applied to any chain which is mainly made up of closed links, and where the addition or removal of extra links is neither desirable nor possible. Accordingly, it is possible that a chain be manufactured from any material. For example, a metal like iron, aluminium, brass or similar, or out of plastic, e.g. polymer, or in case of the principal chain, e.g. jewelry made of precious metal, for example gold. Also, other materials such as ceramic or minerals can be used for chains pursuant to the invention.

BRIEF DESCRIPTION OF THE DRAWINGS

The invention will be explained by means of the following illustrations.

DETAILED DESCRIPTION

Figure 1A:
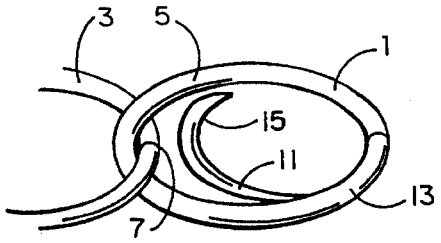
FIGS. 1*a* and 1*b* show the arrangement of two successive links for either lengthening or shortening a chain pursuant to a first embodiment of the invention.
Figure 1B:
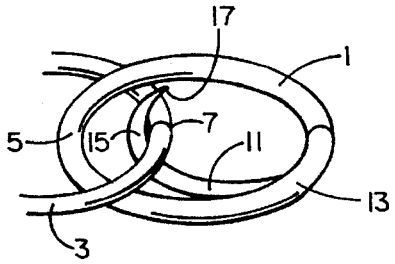

In FIGS. 1*a* and 1*b* the basic thought behind the invention is illustrated by two successive links of one of the chains pursuant to the invention. Closed link 1 follows closed link 3. Links 1 and 3 are coupled to each other in that segment 5 of link 1 grips the segment 7 of link 3. Further, link 1 has an interior hook 11, one end of which is connected to link 1. On the opposite end of hook 11 is a hook-shaped segment 15 which is spaced inwardly from the periphery of link 1.

When the chain is shortened, segment 7 of link 3 moves towards the hooked segment 15 which lies at the interior of link 1. By using manual pressure on interior hook 11, segment 15 is moved within link 1 to create a passage 17. Now segment 7 of link 3 can be moved through passage 17 so as to grip the hooked segment 15 of link 1. After releasing the pressure on hook 11, passage 17 is substantially closed, whereby link 3 is coupled to hooked segment 15 of link 1. In this way the chain is shortened by a length equal to the distance between hooked segment 15 and segment 5 of link 1. In the case of a chain being exclusively composed of links, such as link 1, then the length of the chain can be varied, i.e. lengthened or shortened up to about one-third of the total length.

Figure 2:
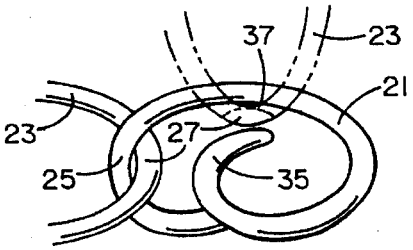
FIG. 2 shows a further arrangement for lengthening or shortening a linked chain pursuant to a second embodiment of the invention.

In FIG. 2, a further systematic arrangement is shown for lengthening and shortening a chain which is made up of closed links. In this regard, two successive links 21 and 23 are shown where link 23 has a segment 27 that is coupled to a segment 25 of the adjacent link 21. The exterior wall of link 21 is shown with a hook 35 turning inwardly therefrom to retain segment 27 of link 23 when the whole chain is to be shortened. Hook 35 is spaced from the exterior wall of link 21 so that a passage 37 is established therebetween. The cross-section of passage 37 is sized so that link 23 cannot be moved therethrough with the link turned in a lengthwise direction relative to the cross-section of passage 37.

In the case where link 23 should be moved to the shorter position, link 27 must be moved in the direction as shown in phantom, i.e. link 23 must be moved along a wall diagonal to link 21 whereby a movement through passage 37 is possible. After this movement, link 23 is again manipulated lengthwise, and hook 35 is in a gripping position to retain link 23. In turn, a chain made up mainly of links such as link 21 having a hook 35 can be greatly shortened or lengthened-by a distance as much as one-third or even a half of the total length of the chain.

Figure 3A:
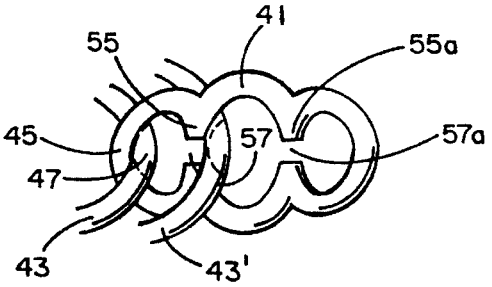
FIGS. 3*a* and 3*b* show another arrangement for lengthening or shortening a linked chain pursuant to a third embodiment of the invention.
Figure 3B:
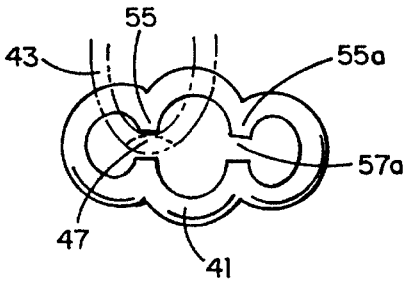

In FIGS. 3*a* and 3*b*, a further variation of a chain pursuant to the invention is illustrated where the principle shown is very similar to the one shown in FIG. 2. In a first link 41, a consecutive second link 43 is attached thereto by coupling respective end segments 45 and 47. Further, link 43 must be swivelled at least 60° to 90° as FIG. 3*b* shows, so that segment 47 can be moved through a first passage 57 inward of link 41 in order to be in the position designated 43'. Novel for link 41 in FIG. 3 is that two shortening possibilities are given, such that link 43 can be positioned along a segment 55 of link 41 as well as along an opposing segment 55*a*. Two possibilities to shorten are available when the second amounts to more than half of the total length of the first link 41. Of course it is possible theoretically to provide three or more shortening positions.

Figure 4A:
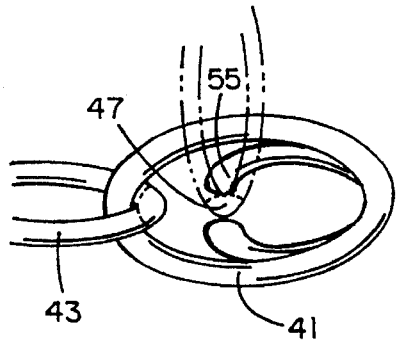
FIGS. 4*a* and 4*b* show yet another arrangement for lengthening or shortening a linked chain pursuant to a fourth embodiment of the invention.
Figure 4B:
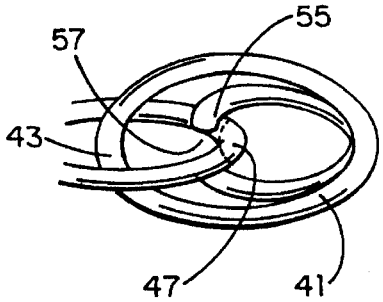

In FIGS. 4*a* and 4*b*, a chain pursuant to the invention is shown having a link 41 that is similar to the links of FIGS. 2 and 3. Here an inside gripping segment of link 41 is shown as a clamp 55, where between an opposing pair of clamp arms a passage 57 is provided for the movement therethrough of the end segment 47 of the next link 43. Both arms of clamp 55 can be rigid or spring biased slightly so that the movement of the following link 43 is facilitated by widening passage 57.

Figure 5A:
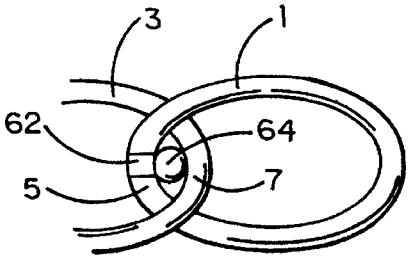
FIGS. 5*a* and 5*b* show still another arrangement for lengthening or shortening a linked chain pursuant to a fifth embodiment of the invention.
Figure 5B:
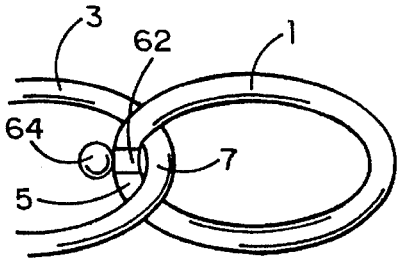

In FIGS. 5*a* and 5*b*, a further embodiment of a link pursuant to the invention is illustrated. First link 1 is coupled to the next link 3 at a swivelling segment 62 which is joined to a rotatable ball-shaped element 64. This rotating ball-shaped element 64 holds the segment 7 of link 3 spaced inwardly from the segment 5 of link 1.

In the case of FIG. 5*a*, both links 1 and 3 are shown in the shorter position, whereas FIG. 5*b* illustrates ball-shaped element 64 rotated so that both links 1 and 3 are in the lengthened position, whereby the expression "shorten" and "lengthen" are of course understood to apply to the entire length of the chain.

In FIG. 5*b* swivelling segment 62 is turned 180° at the end of segment 5 whereas ball-shaped element 64 is also rotated 180°. Now link 3 lies directly with its segment 7 on segment 5 of link 1 whereby the entire length of the chain is lengthened.

Ball-shaped element 64 can of course be an oval-shaped element, a cubically-shaped element or any other shape, for example containing a precious stone whereas this functional element can further enhance the creative impression of the chain.

The variation shown in FIGS. 5*a* and 5*b* is particularly suitable for the shortening and lengthening of so-called "Panzer" chains, which as a general rule are made out of solid gold, whereby the ball or oval-shaped body shown could also be made out of solid gold. Furthermore, it would be possible that ball-shaped element 64 would only be turned 90° giving the chain another appearance.

Figure 6:
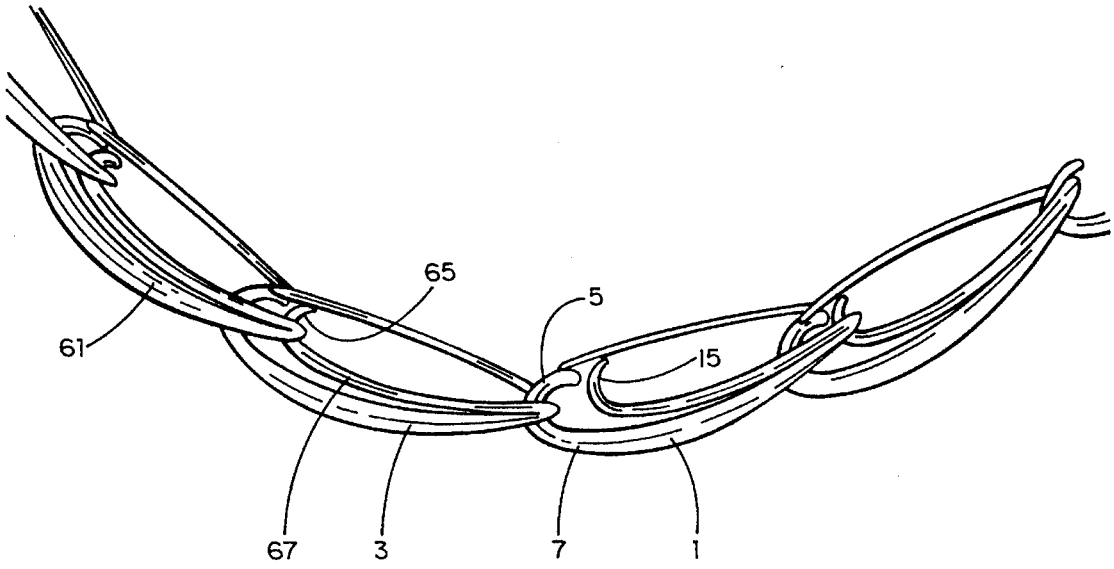
FIG. 6 shows a section of a necklace adjusted in length according to the first embodiment illustrated in FIGS. 1*a* and 1*b*.

In FIG. 6, a longer section of a necklace is illustrated, including links such as the link 1 shown in FIG. 1. Here link 3 which follows link 1 is held in a "lengthened" position by sections 5 to 7. Link 3 is identical to link 1. Following link 3, a further similarly formed link 61 is arranged, which is held in a shorter position by end section 65 in the interior hook 67 of link 3.

When the entire necklace is made up of individual links analogous to link 1, two consecutive links can either be arranged in a shorter or longer position. In this way the length of the entire chain can be varied, almost without limitation, between a longer and a shorter length, in that not all links need be positioned either long or short. It is also possible to shorten only two consecutive links, leaving the other links remaining in the lengthened position. Furthermore, it is possible to shorten two, three or five, etc. consecutive links.

Figure 7B:
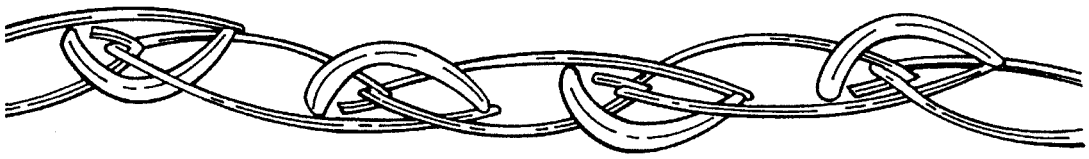
FIGS. 7*a* and 7*b* show sections of other chains pursuant to the invention where in FIG. 7*a* the chain is shown in the lengthened state and in FIG. 7*b* in the shortened state.
Figure 7A:
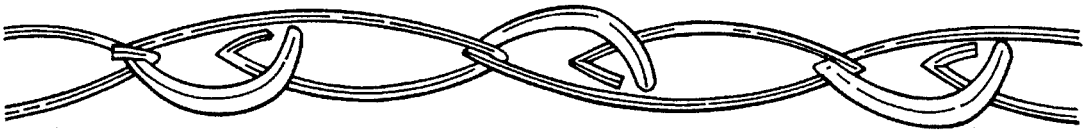
Figure 7C:
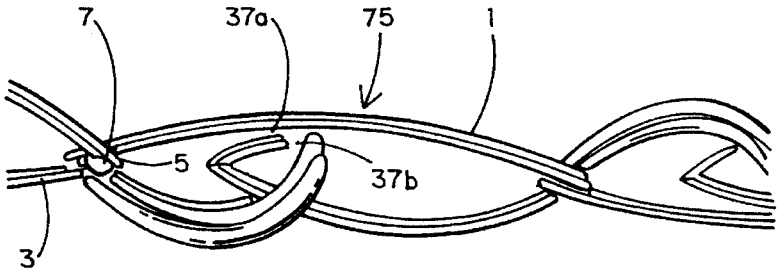
FIG. 7*c* shows a link of the chain shown in FIG. 7*a*.

In FIGS. 7*a* and 7*b*, a further embodiment of the chain pursuant to the invention is shown, where FIG. 7*a* shows the chain lengthened and FIG. 7*b* shows the shorter version of the chain. In FIG. 7*c*, a section of link 1 is shown where the outer wall penetrates itself so that an inner hook 15 is formed which has a sloping section 75 so that two passages 37*a* and 37*b* are formed. In this way it is possible to have additional security that the chain cannot move itself from the shortened to the lengthened position, and in spite of this, passages 37*a* and 37*b* can have a profile so that the movement of the following link is relatively easy.

Figure 8:
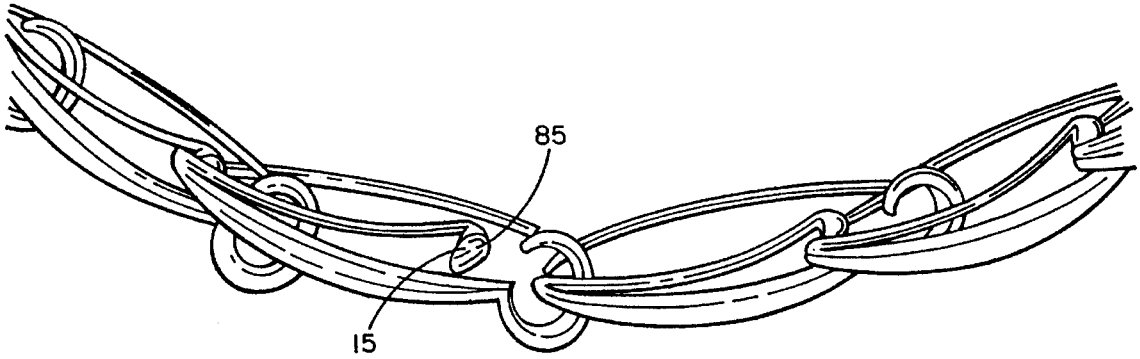
FIG. 8 shows a section of another necklace that is formed pursuant to the invention.

Finally, FIG. 8 shows a section of a further chain pursuant to the invention where grasping hook 15 is shown as a teardrop in order to hold a precious stone 85. The chain in FIG. 8 shows two consecutive links which are arranged in the shorter position as well as two consecutive links arranged in the longer position.

The links or chains shown in FIGS. 1 to 8 are of course only examples which are suitable to illustrate the basics of the invention. Naturally it is possible for the individual links of the chain pursuant to the invention to be developed in an alternate way, and it is also possible to transfer the basic idea of this necklace, etc., to chains which are made up of closed links which should be shortened or lengthened. Appropriately, the material of the individual links can be varied and adapted to different needs and uses. The invention is also suitable for the shortening and lengthening of so-called endless chains, e.g. covering a clasp/opening to open or close the chain, or for limited chains such as those which are used to hang up lamps and the like. In this way, it is possible to lower or raise a ceiling lamp which is hung on a chain without additional links or supplementary tools.

I claim:

1. A chain having a length and comprising a plurality of chain links, each of said chain links having an outer periphery surrounding an interior and being linked to an adjacent chain link, so that said adjacent chain links can not be detached from one another, and a retaining segment projecting from one point on the outer periphery of at least a first of said plurality of chain links inwardly of said outer periphery and into the interior thereof towards a second point on the outer periphery of said first chain link such that a passage is established between said retaining segment and said second point, said passage permitting a second of said plurality of chain links that is adjacent and linked to said first chain link to be moved through said passage and past said retaining segment so as to be engaged by and coupled to said retaining segment at the interior of said first chain link to shorten the length of said chain between said first and second chain links.

2. The chain recited in claim 1, wherein said retaining segment is a hook extending from said one point on outer the periphery of said first chain link into the interior of said first chain link to capture said second chain link, whereby said second chain link is engaged by and coupled to said hook.

3. The chain recited in claim 2, wherein the size of said passage is smaller than the cross-section of said second chain link, the size of said passage increasing to accommodate said second chain link therethrough when said second chain link is moved into said passage.

4. The chain recited in claim 3, wherein said hook of said first chain link is resilient and adapted to be moved away from said second point on outer the periphery of said first chain link to increase the size of said passage between said hook and said second point so that said second chain link can be moved through said passage and past said hook.

5. A chain having a length and comprising a plurality of chain links, each of said chain links having a periphery surrounding an interior and being linked to an adjacent chain link, and a first retaining segment extending completely across the interior of at least a first of said plurality of chain links, said first retaining segment having a first passage formed therein to permit a second of said plurality of chain links that is adjacent and linked to said first chain link to be moved through said first passage and past said first retaining segment so as to be engaged by and coupled to said first retaining segment at the interior of said first chain link to shorten the length of said chain between said first and second chain links, said first passage in said first retaining segment being smaller than the cross-section of said second chain link, said first retaining segment being resilient and adapted to be moved to increase the size of said first passage so that said second chain link can be moved through said first passage and past said first segment.

6. The chain recited in claim 5, further comprising a second retaining segment extending completely across the interior of said first chain link, said second retaining segment spaced from said first retaining segment and having a second passage formed therein to permit said second chain link to be moved through said second passage and past said second retaining segment so as to be engaged by and coupled to said second retaining segment of said first chain link after said second chain link has been moved through said first passage of said first retaining segment.

7. A chain having a length and comprising a plurality of chain links, each of said chain links having a periphery surrounding an interior and being linked to an adjacent chain link, and retaining means projecting from and rotatably connected to the periphery of at least a first of said plurality of chain links, said retaining means being rotated between a first position outside the periphery of said first chain link to a second position inside the periphery of said first chain link, said retaining means being rotated to said second position and into the interior of said first chain link at which to engage a second of said plurality of chain links that is adjacent and linked to said first chain link to shorten the length of said chain between said first and second chain links.

8. The chain recited in claim 7, wherein said retaining means has a first end rotatably connected to and projecting from the periphery of said first chain link and an opposite ball-shaped end.

* * * * *